United States Patent [19]

Foster

[11] Patent Number: 4,749,604

[45] Date of Patent: Jun. 7, 1988

[54] DISPLAY AND STORAGE ARRANGEMENT

[76] Inventor: Sybil A. Foster, 6710 Newburgh Rd., Evansville, Ind. 47715

[21] Appl. No.: 18,477

[22] Filed: Feb. 25, 1987

[51] Int. Cl.[4] ..... A47G 9/00; B44C 5/04

[52] U.S. Cl. ..... 428/100; 248/205.2; 428/102; 428/913.3

[58] Field of Search ..... 428/100, 13, 913.3; 248/205.2, DIG. 12

[56] References Cited

U.S. PATENT DOCUMENTS

| | | | |
|---|---|---|---|
| 3,525,376 | 8/1970 | Muhlhauser | 428/100 X |
| 3,529,649 | 9/1970 | Bennett | 428/100 X |
| 4,193,152 | 3/1980 | Seibold, Jr. | 428/100 X |
| 4,309,784 | 1/1982 | Cohen | 428/13 X |
| 4,452,362 | 6/1984 | Mancin | 248/205.2 X |
| 4,534,065 | 8/1985 | Comfort | 428/100 X |
| 4,543,278 | 9/1985 | Ackerman | 428/18 |
| 4,548,375 | 10/1985 | Moss | 248/205.2 |
| 4,595,618 | 6/1986 | Caringer | 428/100 |
| 4,620,396 | 11/1986 | Bjorntwedt | 428/100 X |

*Primary Examiner*—Henry F. Epstein

*Attorney, Agent, or Firm*—Warren D. Flackbert

[57] ABSTRACT

A display and storage arrangement for accessory items characterized by a body member assuming a variety of configurations in plan view and defined by an upper fabric layer and a bottom fabric layer, with a batting and/or filler material layer disposed therebetween. A series of closures is arranged on the outer surface of the upper layer in a manner reflecting the needs of the user. The closures may assume a variety of forms and, typically, include Velcro fastening for ready accessory item removal and/or placement, being individual, in pairs, and for locating bands which receive a series of individual items. The finished unit presents a pleasing appearance, serving, as well, effective utilitarian purposes.

4 Claims, 1 Drawing Sheet

DISPLAY AND STORAGE ARRANGEMENT

As is known, an ever increasing need arises for the effective storage of personal accessory items, such as women's and men's jewelry, for example. Additionally, it is oftentimes desired to provide for the ready display of the aforesaid items, as in the instance of uniqueness in appearance or for ready selection and/or availability reasons. Typically, items of the aforesaid type have been retained within a closed case or box, usually positioned on an exposed supporting surface or within a drawer or on a shelf.

In contrast to the preceding, the invention presents an arrangement for article display and storage which serves both ornamental and utilitarian purposes. More specifically, the invention is defined by fabric layers between which batting and/or filler material is disposed, where the fabric layers may assume various configurations in plan view as, for example, a shape approximating a cloud. In other words, the arrangement herein presents, in general form, a relatively thin modified form of pillow or cushioning.

In any event, the accessory items for display and/or storage may be directly retained on the body of the arrangement or, alternatively, positioned by means of selectively placed Velcro retained closures, where the latter may be in the form of loops for receiving rings, necklace ends or the like, or bands, with the desired items directly secured thereto. The retaining or securing arrangements may be aesthetically arranged on the top layer of the body, i.e. in a manner to accommodate the type and variety of items involved and, as well, to provide other space for direct item placement.

A better understanding of the present invention will become more apparent from the following description, taken in conjunction with the accompanying drawing, wherein

Figure 1:
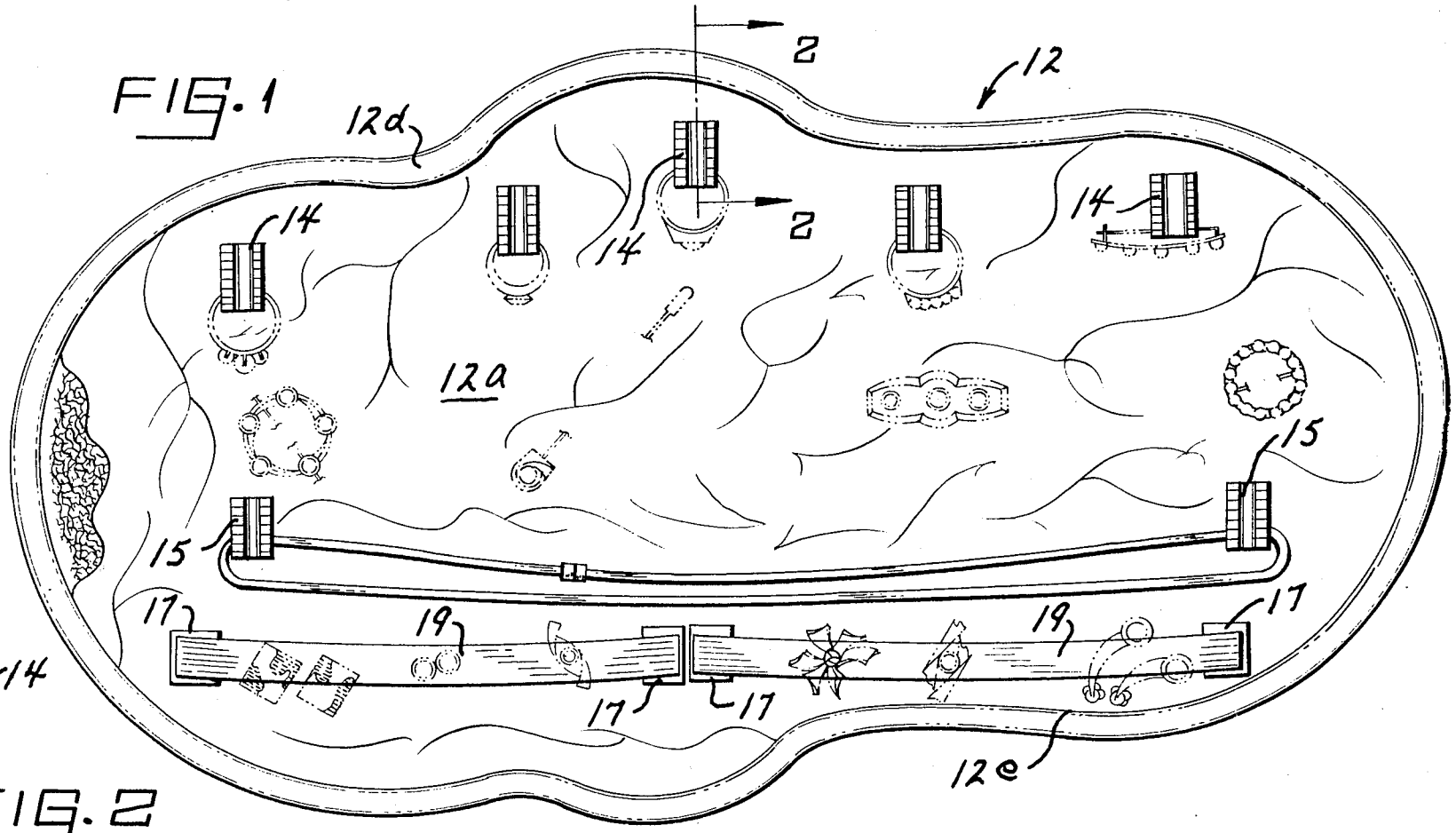
FIG. 1 is a top plan view showing the display and storage arrangement in accordance with the teachings of the present invention; and, FIG. 2 is a view in vertical section, taken line 2—2 on FIG. 1 and looking in the direction of the arrows, detailing the instant display and storage arrangement.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the display and storage arrangement of the invention is defined by a body member 12 including an upper or top fabric layer 12*a*, a lower or bottom fabric layer 12*b*, a layer of batting and/or filler material disposed between the preceding layers 12*a* and 12*b*, and, in one form, a hem or border 12*d*, all typically assembled by stitching, at 12*e*.

Top layer 12*a* is preferably a heavy decorative fabric, either, for example, textured, ribbed or plain, while bottom layer 12*b* is also a heavy fabric, but not necessarily decorative, aside form color, because it rests on a support surface and is not generally visable.

The hem or border 12*d* may be plain, ruffled, or even in the form of lace. In any event, the batting and/or filler layer is typically made from a polyester material which presents dense physical properties so as to achieve higher lift for the assembled unit.

Figure 2:
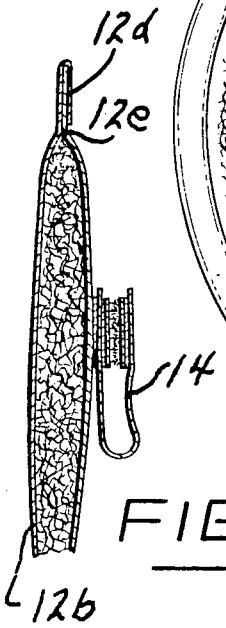

As evident in FIG. 2, the instant display and storage arrangement includes an assortment of closures 14, each being typically defined to include loop-pile retaining combinations commercially marketed as Velcro. Each of the closures 14 is suitably secured or affixed to top layer 12*a*, as by stitching or the use of an adhesive material, but is selectively openable (and closable—through Velcro fastening) to receive an article for display and/or storage, as a ring, clip, or the like.

Other similar closures 15 arranged on top layer 12*a* serve to selectively receive the looped ends, for example, of a necklace, where still further closures 17 each serve to receive a Velcro secured band 19 on which an item for display and/or storage is secured. Aside from the usage of closures 14, 15 and 17, a desired item can be directly retained on the top layer 12*a*, as by pinning (note the phantom representations on FIG. 1 in this connection).

In any event, it should be evident that the display and storage arrangement of the invention presents a readily usably and mobile approach in use, making the accessory items immediately visable and readily selected. The body member 12 of the arrangement is such that vertical stacking is capable, meaning ease in multiple storage and/or quantity shipment.

Further, ornamentation variations are manyfold, not only in plan view shape, but also because the aforesaid closures may be presented in a variety of arrangements, i.e. making each unit personalized to the user's needs and/or desires.

The display and storage arrangement described hereabove is, of course, susceptible to various changes within the spirit of the invention, including, for example, and as stated, the plan configuration of the body portion; overall proportioning; fabric selection; the type of batting or filler material employed; and, the like. Thus, the preceding should be considered illustrative and not as limiting the scope of the following claims:

I claim:

1. A display and storage arrangement comprising a body portion defined by a top layer, a bottom layer, and a filler layer disposed between said top layer and said bottom layer in an assembled sandwich relationship, and a variety of types of securements anchored on said top layer to selectively receive and release items for storage and display including an independent closure, a pair of closures in a spaced-apart relationship to retain the ends of an elongated item, and a band serving to retain multiple items.

2. The display and storage arrangement of claim 1 where said top layer and said bottom layer are stitched together.

3. The display and storage arrangement of claim 1 where a border extends outwardly from the juncture of said top layer and said bottom layer.

4. The display and storage arrangement of claim 1 where said body portion is resilient.

* * * * *